US011629298B2

(12) United States Patent
Koseoglu

(10) Patent No.: US 11,629,298 B2
(45) Date of Patent: Apr. 18, 2023

(54) DUAL FLUID CATALYTIC CRACKING REACTOR SYSTEMS AND METHODS FOR PROCESSING HYDROCARBON FEEDS TO PRODUCE OLEFINS

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/931,847

(22) Filed: May 14, 2020

(65) Prior Publication Data

US 2021/0355389 A1 Nov. 18, 2021

(51) Int. Cl.
*C10G 51/02* (2006.01)
*C10G 51/00* (2006.01)

(52) U.S. Cl.
CPC ..... *C10G 51/026* (2013.01); *C10G 2300/107* (2013.01); *C10G 2300/301* (2013.01); *C10G 2300/701* (2013.01); *C10G 2400/20* (2013.01)

(58) Field of Classification Search
None
See application file for complete search history.

(56) References Cited

U.S. PATENT DOCUMENTS 4,116,814 A 9/1978 Zahner
4,830,728 A 5/1989 Herbst et al.
5,009,769 A 4/1991 Goelzer
7,083,762 B2 8/2006 Kuechler et al.
7,220,351 B1 5/2007 Pontier et al.
7,597,796 B2 10/2009 Andreux et al.
8,163,247 B2 4/2012 Lomas et al.
9,777,228 B2 10/2017 Davydov
9,896,627 B2 2/2018 Koseoglu
(Continued)

FOREIGN PATENT DOCUMENTS

WO 2013089885 A1 6/2013

OTHER PUBLICATIONS

International Search Report and Written Opinion dated Jan. 29, 2021 pertaining to International application No. PCT/US2020/047872 filed Aug. 26, 2020, 13 pgs.

*Primary Examiner* — Tam M Nguyen
(74) *Attorney, Agent, or Firm* — Dinsmore & Shohl LLP

(57) ABSTRACT

A method for processing a hydrocarbon feed to produce olefins may comprise introducing the hydrocarbon feed to a first fluid catalytic cracking system, which may cause at least a portion of the hydrocarbon feed to undergo catalytic cracking and produce a spent first cracking catalyst and a first cracked effluent comprising one or more olefins. The method may further comprise passing the first cracked effluent to a separation system downstream of the first fluid catalytic cracking system, which may separate the first cracked effluent to produce at least a naphtha effluent comprising one or more olefins. Additionally, the method may comprise passing the naphtha effluent to a second fluid catalytic cracking system downstream of the separation system, which may cause at least a portion of the naphtha effluent to undergo catalytic cracking and produce a spent cracking catalyst mixture and a second cracked effluent comprising one or more olefins.

16 Claims, 1 Drawing Sheet

(56) References Cited

U.S. PATENT DOCUMENTS

| | | | | |
|---|---|---|---|---|
| 11,142,703 | B1 * | 10/2021 | Koseoglu | B01J 35/1038 |
| 2006/0108260 | A1 | 5/2006 | Henry | |
| 2012/0241359 | A1 * | 9/2012 | Al-Thubaiti | B01D 3/009 422/187 |
| 2015/0375218 | A1 * | 12/2015 | Koseoglu | B01J 21/16 502/68 |
| 2018/0346827 | A1 * | 12/2018 | Al-Ghamdi | B01J 38/38 |
| 2020/0291306 | A1 * | 9/2020 | Aitani | C10G 51/026 |
| 2021/0246387 | A1 * | 8/2021 | Koseoglu | C10G 45/44 |
| 2021/0269725 | A1 * | 9/2021 | Pechimuthu | C10G 51/026 |
| 2022/0081624 | A1 * | 3/2022 | Akah | C10G 51/06 |

* cited by examiner

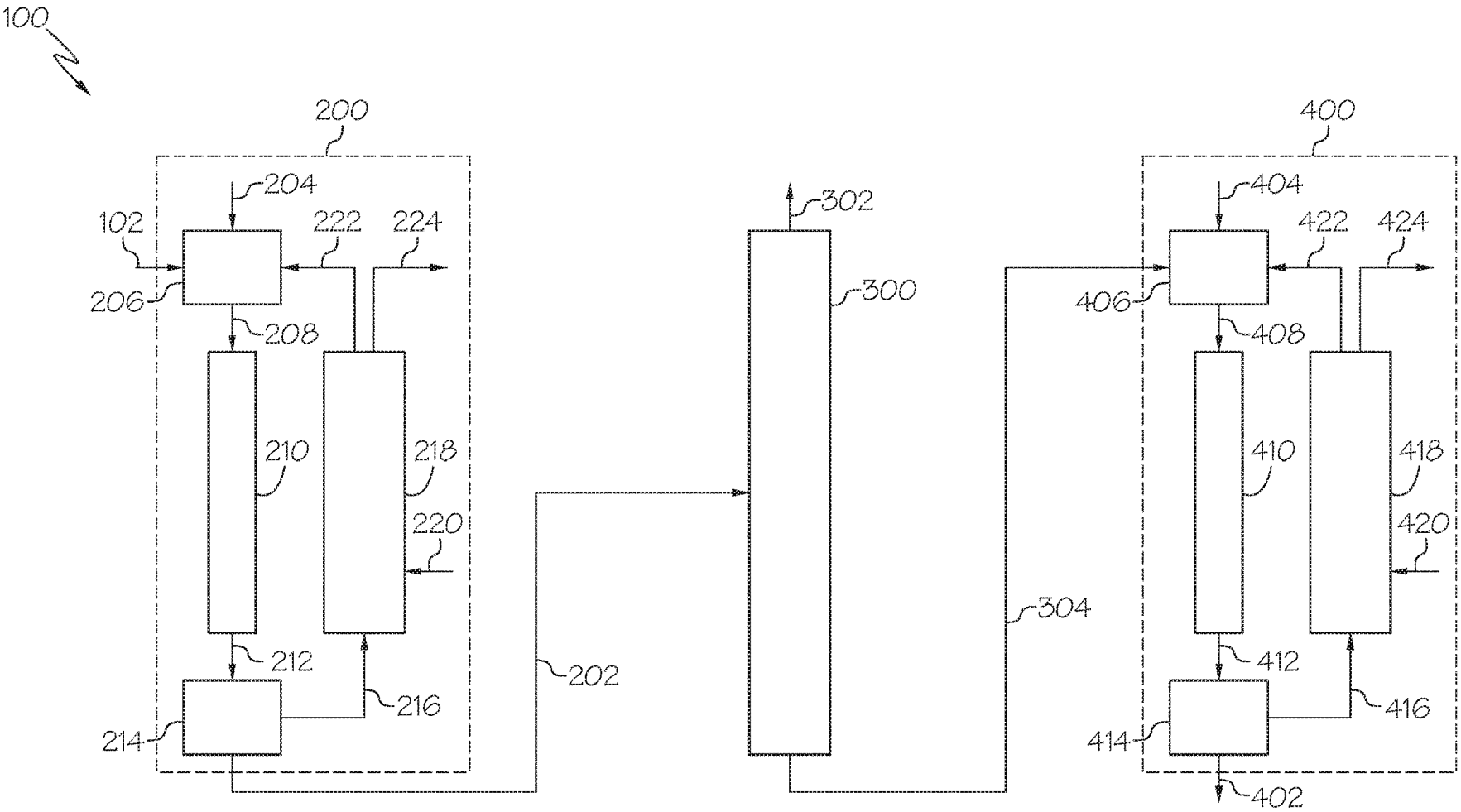
100
102
200
202
204
206
208
210
212
214
216
218
220
222
224
300
302
304
400
402
404
406
408
410
412
414
416
418
420
422
424

DUAL FLUID CATALYTIC CRACKING REACTOR SYSTEMS AND METHODS FOR PROCESSING HYDROCARBON FEEDS TO PRODUCE OLEFINS

BACKGROUND

Field

The present disclosure relates to systems and methods for processing petroleum-based materials and, in particular, systems and methods for processing a hydrocarbon feed to produce olefins.

Technical Background

Ethylene, propylene, butene, butadiene, and aromatics compounds, such as benzene, toluene, and xylenes, are basic intermediates for the petrochemical industry. These compounds are typically produced through thermal cracking (or steam pyrolysis) of petroleum gases and distillates, such as naphtha, kerosene, or gas oil. These compounds may also be produced through fluid catalytic cracking processes where conventional heavy hydrocarbon feeds, such as gas oils or residues, are catalytically cracked. Typical hydrocarbon feeds for fluid catalytic cracking processes range from hydrocracked bottoms to heavy feed fractions such as vacuum gas oil and atmospheric residue; however, these hydrocarbon feeds are limited. The second most important source for propylene production is currently refinery propylene from fluid catalytic cracking processes.

The worldwide increasing demand for light olefins remains a major challenge for many integrated refineries. In particular, the production of some valuable light olefins, such as ethylene and propylene, has attracted increased attention as pure olefin streams are considered the building blocks for polymer synthesis. The production of light olefins depends on the system, including the system configuration, and on several process variables, such as the feed type, operating conditions, and the type of catalyst. Despite the options available for producing a greater yield of propylene and light olefins, intense research activity in this field is still being conducted. These options include the use of high-severity operating conditions, developing more selective catalysts for the process, and enhancing the configuration of the process in favor of more advantageous reaction conditions and yields. Fluid catalytic cracking systems operated under high-severity conditions are capable of producing yields of propylene up to four times greater than traditional fluid catalytic cracking systems and greater conversion levels for a range of hydrocarbon feeds. However, even under high-severity conditions, fluid catalytic cracking systems can produce substantial amounts of heavy olefins, such as butenes and pentenes, and other larger hydrocarbons, such as butane and isobutane. Production of these larger hydrocarbons, which may be of lesser value as chemical intermediates compared to propylene and ethylene, may reduce the selectivity and yield of propylene, ethylene, or both, from the fluid catalytic cracking system.

SUMMARY

Accordingly, there is an ongoing need for systems and methods for processing hydrocarbon feeds to produce olefins with a greater selectivity and yield of propylene, ethylene, or both, compared to conventional systems and methods for processing hydrocarbon feeds. The systems and methods of the present disclosure comprise the processing of a hydrocarbon feed in two fluid catalytic cracking systems arranged in series and operated under high-severity conditions. In particular, the methods of the present disclosure comprise contacting the hydrocarbon feed with a first cracking catalyst under high-severity conditions to produce a first cracked effluent, separating the first cracked effluent to produce at least a naphtha effluent, and contacting the naphtha effluent with a cracking catalyst mixture comprising a second cracking catalyst and a cracking catalyst additive under high-severity conditions to produce a second cracked effluent. The inclusion of two fluid catalytic cracking systems arranged in series and operated at high-severity conditions may increase the selectivity and yield of ethylene, propylene, or both, from the olefin process.

According to at least one aspect of the present disclosure, a method for processing a hydrocarbon feed to produce olefins comprises introducing the hydrocarbon feed to a first fluid catalytic cracking system. The first fluid catalytic cracking system may contact the hydrocarbon feed with a first cracking catalyst at a first cracking temperature greater than or equal to 480 degrees Celsius. The contact may cause at least a portion of the hydrocarbon feed to undergo catalytic cracking and produce a spent first cracking catalyst and a first cracked effluent comprising one or more olefins. The method may further comprise passing the first cracked effluent to a separation system downstream of the first fluid catalytic cracking system. The separation system may separate the first cracked effluent to produce at least a naphtha effluent comprising one or more olefins. Additionally, the method may comprise passing the naphtha effluent to a second fluid catalytic cracking system downstream of the separation system. The second fluid catalytic cracking system may contact the naphtha effluent with a cracking catalyst mixture comprising a cracking catalyst additive at a second cracking temperature greater than or equal to 580 degrees Celsius. The contact may cause at least a portion of the naphtha effluent to undergo catalytic cracking and produce a spent cracking catalyst mixture and a second cracked effluent comprising one or more olefins.

According to at least one aspect of the present disclosure, a system for processing a hydrocarbon feed to produce olefins comprising a first fluid catalytic cracking system, a separation system downstream of the first fluid catalytic cracking system, and a second fluid catalytic cracking system downstream of the separation system. The first fluid catalytic cracking system may be operable to contact the hydrocarbon feed with a first cracking catalyst at a first cracking temperature greater than or equal to 480 degrees Celsius. The contact may cause at least a portion of the hydrocarbon feed to undergo catalytic cracking and produce a spent first cracking catalyst and a first cracked effluent comprising one or more olefins. The separation system may be operable to separate the first cracked effluent to produce at least a naphtha effluent comprising one or more olefins. The second fluid catalytic cracking system may be operable to contact the naphtha effluent with a cracking catalyst mixture comprising a cracking catalyst additive at a second cracking temperature greater than or equal to 580 degrees Celsius. The contact may cause at least a portion of the naphtha effluent to undergo catalytic cracking and produce a spent cracking catalyst mixture and a second cracked effluent comprising one or more olefins.

Additional features and advantages of the aspects of the present disclosure will be set forth in the detailed description that follows and, in part, will be readily apparent to a person of ordinary skill in the art from the detailed description or recognized by practicing the aspects of the present disclosure.

BRIEF DESCRIPTION OF THE DRAWINGS

The following detailed description of the present disclosure may be better understood when read in conjunction with the following drawing in which:

FIG. 1 schematically depicts a generalized flow diagram of a system for processing a hydrocarbon feed to produce olefins, according to one or more aspects of the present disclosure.

When describing the simplified schematic illustration of FIG. 1, the numerous valves, temperature sensors, electronic controllers, and the like, which may be used and are well known to a person of ordinary skill in the art, are not included. Further, accompanying components that are often included in systems such as those depicted in FIG. 1, such as air supplies, heat exchangers, surge tanks, and the like are also not included. However, a person of ordinary skill in the art understands that these components are within the scope of the present disclosure.

Additionally, the arrows in the simplified schematic illustration of FIG. 1 refer to process streams. However, the arrows may equivalently refer to transfer lines, which may transfer process streams between two or more system components. Arrows that connect to one or more system components signify inlets or outlets in the given system components and arrows that connect to only one system component signify a system outlet stream that exits the depicted system or a system inlet stream that enters the depicted system. The arrow direction generally corresponds with the major direction of movement of the process stream or the process stream contained within the physical transfer line signified by the arrow.

The arrows in the simplified schematic illustration of FIG. 1 may also refer to process steps of transporting a process stream from one system component to another system component. For example, an arrow from a first system component pointing to a second system component may signify "passing" a process stream from the first system component to the second system component, which may comprise the process stream "exiting" or being "removed" from the first system component and "introducing" the process stream to the second system component.

Reference will now be made in greater detail to various aspects, some of which are illustrated in the accompanying drawing.

DETAILED DESCRIPTION

The present disclosure is directed to systems and methods for processing hydrocarbon feeds in a dual fluid catalytic cracking reactor system operated to produce olefins. Referring to FIG. 1, a system 100 of the present disclosure for processing a hydrocarbon feed 102 to produce olefins is schematically depicted. The system 100 may comprise a first fluid catalytic cracking system 200, a separation system 300 downstream of the first fluid catalytic cracking system 200, and a second fluid catalytic cracking system 400 downstream of the separation system 300. In operation, a method for processing the hydrocarbon feed 102 to produce olefins may comprise introducing the hydrocarbon feed 102 to the first fluid catalytic cracking system 200. The first fluid catalytic cracking system 200 may contact the hydrocarbon feed 102 with a first cracking catalyst under standard or high-severity conditions, such as a temperature greater than or equal to 580 degrees Celsius (° C.), a residence time less than or equal to 30 seconds, a catalyst to oil ratio greater than or equal to 1, or combinations of these. The contact of the hydrocarbon feed 102 with the first cracking catalyst may cause at least a portion of the hydrocarbon feed 102 to undergo catalytic cracking and produce a spent first cracking catalyst 216 and a first cracked effluent 202 comprising one or more olefins. The method may further comprise passing the first cracked effluent 202 to the separation system 300 downstream of the first fluid catalytic cracking system 200. The separation system 300 may separate the first cracked effluent 202 to produce at least a naphtha effluent 304 comprising one or more olefins. The method may further comprise passing the naphtha effluent 304 to the second fluid catalytic cracking system 400 downstream of the separation system 300. The second fluid catalytic cracking system 400 may contact the naphtha effluent 304 with a cracking catalyst mixture comprising a second cracking catalyst and a cracking catalyst additive under high-severity conditions, such as a temperature greater than or equal to 580° C., a residence time less than or equal to 60 seconds, a catalyst to oil ratio greater than or equal to 1, or combinations of these. The contact of the naphtha effluent 304 with the cracking catalyst mixture under high-severity conditions may cause at least a portion of the naphtha effluent 304 to undergo catalytic cracking to produce a spent cracking catalyst mixture 416 and a second cracked effluent 402 comprising one or more olefins.

As used in the present disclosure, the indefinite articles "a" and "an," when referring to elements of the present disclosure, mean that at least one of these elements are present. Although these indefinite articles are conventionally employed to signify that the modified noun is a singular noun, the indefinite articles "a" and "an" also include the plural in the present disclosure, unless stated otherwise. Similarly, the definite article "the" also signifies that the modified noun may be singular or plural in the present disclosure, unless stated otherwise.

As used in the present disclosure, the term "or" is inclusive and, in particular, the term "A or B" refers to "A, B, or both A and B." Alternatively, the term "or" may be used in the exclusive sense only when explicitly designated in the present disclosure, such as by the terms "either A or B" or "one of A or B."

As used in the present disclosure, the term "cracking" refers to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds. As used in the present disclosure, the term "catalytic cracking" refers to cracking conducted in the presence of a catalyst. Some catalysts may have multiple forms of catalytic activity, and calling a catalyst by one particular function does not render that catalyst incapable of being catalytically active for other functionality.

As used in the present disclosure, the term "catalyst" refers to any substance which increases the rate of a specific chemical reaction, such as cracking reactions.

As used in the present disclosure, the term "spent catalyst" refers to catalyst that has been contacted with reactants at reaction conditions, but has not been regenerated in a regenerator. The "spent catalyst" may have coke deposited on the catalyst and may include partially coked catalyst as well as fully coked catalysts. The amount of coke deposited on the "spent catalyst" may be greater than the amount of coke remaining on the regenerated catalyst following regeneration.

As used in the present disclosure, the term "regenerated catalyst" refers to catalyst that has been contacted with reactants at reaction conditions and then regenerated in a regenerator to heat the catalyst to a greater temperature, oxidize and remove at least a portion of the coke from the catalyst to restore at least a portion of the catalytic activity of the catalyst, or both. The "regenerated catalyst" may have less coke, a greater temperature, or both, compared to spent catalyst and may have greater catalytic activity compared to spent catalyst. The "regenerated catalyst" may have more coke and lesser catalytic activity compared to fresh catalyst that has not passed through a cracking reaction zone and regenerator.

As used in the present disclosure, the term "crude oil" refers to a mixture of petroleum liquids and gases, including impurities, such as sulfur-containing compounds, nitrogen-containing compounds, and metal compounds, as distinguished from fractions of crude oil, such as naphtha.

As used in the present disclosure, the term "naphtha" refers to an intermediate mixture of hydrocarbon-containing materials derived from crude oil refining and having atmospheric boiling points from 36° C. to 220° C. Naphtha may comprise light naphtha comprising hydrocarbon-containing materials having atmospheric boiling points from 36° C. to 80° C., intermediate naphtha comprising hydrocarbon-containing materials having atmospheric boiling points from 80° C. to 140° C., and heavy naphtha comprising hydrocarbon-containing materials having atmospheric boiling points from 140° C. to 200° C. Naphtha may comprise paraffinic, naphthenic, and aromatic hydrocarbons having from 4 carbon atoms to 11 carbon atoms.

As used in the present disclosure, the term "directly" refers to the passing of materials, such as an effluent, directly from a first component of system 100 to a second component of system 100 without passing through any intervening components or systems operable to change the composition or characteristics of the materials. Similarly, the term "directly" also refers to the introducing of materials, such as a feed, directly to a component of system 100 without passing through any preliminary components operable to change the composition or characteristics of the materials. Intervening or preliminary components or systems operable to change the composition or characteristics of the materials may comprise reactors and separators, but are not generally intended to include heat exchangers, valves, pumps, sensors, or other ancillary components required for operation of a chemical process.

As used in the present disclosure, the terms "downstream" and "upstream" refer to the positioning of components or systems of the system 100 relative to a direction of flow of materials through the system 100. For example, a second system may be considered "downstream" of a first system if materials flowing through the system 100 encounter the first system before encountering the second system. Likewise, the first system may be considered "upstream" of the second system if the materials flowing through the system 100 encounter the first system before encountering the second system.

As used in the present disclosure, the term "effluent" refers to a stream that is passed out of a reactor, a reaction zone, or a separator following a particular reaction or separation. Generally, an effluent has a different composition than the stream that entered the reactor, reaction zone, or separator. It should be understood that when an effluent is passed to another component or system, only a portion of that effluent may be passed. For example, a slipstream may carry some of the effluent away, meaning that only a portion of the effluent may enter the downstream component or system. The terms "reaction effluent" and "reactor effluent" may be used to particularly refer to a stream that is passed out of a reactor or reaction zone.

As used in the present disclosure, the term "high-severity conditions" refers to operating conditions of a fluid catalytic cracking system, such as the fluid catalytic cracking system 400, that includes temperatures greater than or equal to 580° C., or from 580° C. to 750° C., a catalyst to oil ratio greater than or equal to 1, or from 1 to 60, and a residence time of less than or equal to 60 seconds, or from 0.1 seconds to 60 seconds, each of which conditions may be more severe than typical operating conditions of a fluid catalytic cracking system.

The term "catalyst to oil ratio" refers to the weight ratio of a cracking catalyst, such as the first cracking catalyst or the cracking catalyst mixture of the system 100, to a feed, such as the hydrocarbon feed 102 or the greater boiling point fraction 302 of the system 100.

The term "residence time" refers to the amount of time that reactants, such as the hydrocarbons in the hydrocarbon feed 102 of the system 100, are in contact with a catalyst, such as the first cracking catalyst of the system 100, at reaction conditions, such as at the reaction temperature. For example, the residence time in the first fluid catalytic cracking reactor 210 refers to the time that the hydrocarbons of the hydrocarbon feed 102 are in contact with the first cracking catalyst at the first cracking temperature of greater than or equal to 480° C.

As used in the present disclosure, the term "reactor" or "fluid catalytic cracking reactor" refers to any vessel, container, or the like, in which catalytic cracking may occur between one or more reactants optionally in the presence of one or more fluidized catalysts. For example, fluid catalytic cracking reactors may comprise fluidized bed reactors, such as downflow reactors, upflow reactors or combinations of these. One or more "reaction zones" may be disposed within a reactor. The term "reaction zone" refers to an area where a particular reaction takes place in a reactor.

As used in the present disclosure, the terms "separation system" and "separator" refer to any separation device(s) that at least partially separates one or more chemical constituents in a mixture from one another. For example, a separation system may selectively separate different chemical constituents from one another, forming one or more chemical fractions. Examples of separation systems include, without limitation, distillation columns, fractionators, flash drums, knock-out drums, knock-out pots, centrifuges, filtration devices, traps, scrubbers, expansion devices, membranes, solvent extraction devices, high-pressure separators, low-pressure separators, or combinations or these. The separation processes described in the present disclosure may not completely separate all of one chemical constituent from all of another chemical constituent. Instead, the separation processes described in the present disclosure "at least partially" separate different chemical constituents from one another and, even if not explicitly stated, separation may include only partial separation.

It should further be understood that streams may be named for the components of the stream, and the component for which the stream is named may be the major component of the stream (such as comprising from 50 wt. %, from 70 wt. %, from 90 wt. %, from 95 wt. %, from 99 wt. %, from 99.5 wt. %, or from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "hydrogen stream" passing to a first system component or from a first system component to a second system component should be understood to equivalently disclose "hydrogen" passing to the first system component or passing from a first system component to a second system component.

Referring again to FIG. 1, a system 100 of the present disclosure for processing a hydrocarbon feed 102 to produce olefins is schematically depicted. The system 100 may comprise a first fluid catalytic cracking system 200, a separation system 300 downstream of the first fluid catalytic cracking system 200, and a second fluid catalytic cracking system 400 downstream of the separation system 300. The first fluid catalytic cracking system 200 may comprise a first mixer 206, a first fluid catalytic cracking reactor 210 downstream of the first mixer 206, a first catalyst separator 214 downstream of the first fluid catalytic cracking reactor 210, and a first catalyst regenerator 218 downstream of the first catalyst separator 214. The second fluid catalytic cracking system 400 may comprise a second mixer 406, a second fluid catalytic cracking reactor 410 downstream of the second mixer 406, a second catalyst separator 414 downstream of the second fluid catalytic cracking reactor 410, and a second catalyst regenerator 418 downstream of the second catalyst separator 414. The second mixer 406, second catalyst separator 414, the second fluid catalytic cracking reactor 410, and the second catalyst regenerator 418 are separate from and may operate independent of the first mixer 206, the first catalyst separator 214, the first fluid catalytic cracking reactor 210, and the first catalyst regenerator 218.

The hydrocarbon feed 102 may comprise a mixture of hydrocarbon-containing materials. The hydrocarbon-containing materials of the hydrocarbon feed 102 may comprise hydrocarbons derived from crude oil. The hydrocarbon feed 102 may comprise crude oil, distillates, residues, tar sands, bitumen, atmospheric residue, vacuum gas oils, demetalized oils, naphtha streams, gas condensate streams, or combinations of these. For example, the hydrocarbon feed 102 may comprise distillates boiling at temperatures from 370° C. to 565° C., residues boiling at temperatures greater than or equal to 520° C., or both. The hydrocarbon feed 102 may further comprise one or more non-hydrocarbon constituents, such as metal compounds, sulfur compounds, nitrogen compounds, inorganic compounds, or combinations of these. One or more supplemental feeds (not depicted) may be mixed with the hydrocarbon feed 102 prior to introducing the hydrocarbon feed 102 to the first fluid catalytic cracking system 200 or introduced independently to the first fluid catalytic cracking system 200 in addition to the hydrocarbon feed 102. For example, the hydrocarbon feed 102 may comprise a naphtha stream and one or more supplemental streams, such as vacuum residue, atmospheric residue, vacuum gas oils, demetalized oils, or other hydrocarbon streams, or combinations of these, may be mixed with the hydrocarbon feed 102 upstream of the first fluid catalytic cracking system 200 or introduced independently to the first fluid catalytic cracking system 200.

The hydrocarbon feed 102 may be introduced to the first fluid catalytic cracking system 200. The hydrocarbon feed 102 may be introduced to the first mixer 206 of the first fluid catalytic cracking system 200. The first mixer 206 may be operable to receive the hydrocarbon feed 102, and any supplemental feed streams, and combine the hydrocarbon feed 102 with a first cracking catalyst to form a first mixed catalyst-hydrocarbon stream 208. The first cracking catalyst may comprise a regenerated first cracking catalyst 222, a fresh first cracking catalyst 204, or both. For example, during an initial start-up of the first fluid catalytic cracking system 200 the first cracking catalyst may comprise only the fresh first cracking catalyst 204. However, during steady-state operation of the first fluid catalytic cracking system 200 the first cracking catalyst may comprise only the regenerated first cracking catalyst 222. The fresh first cracking catalyst 204 may also be introduced to the first mixer 206 during steady-state operation of the first fluid catalytic cracking system 200 to replenish any of the first cracking catalyst that is lost due to attrition or removed due to permanent deactivation.

The first cracking catalyst may comprise one or more cracking catalysts that are suitable for use in the first fluid catalytic cracking reactor 210. The first cracking catalyst may also be operable as a heat carrier and may provide heat transfer to the hydrocarbon feed 102 in the first mixer 206. The first cracking catalyst may also have a plurality of catalytically active sites, such as acidic sites that promote the catalytic cracking of at least a portion of the hydrocarbon feed 102. Suitable cracking catalysts may comprise natural or synthetic zeolites, such as Y zeolites, REY zeolites, USY zeolites, and RE-USY zeolites; clays, such as kaolin, montmorilonite, halloysite, and bentonite; inorganic porous oxides, such as alumina, silica, boria, chromia, magnesia, zirconia, titania and silica-alumina; or combinations of these. In embodiments, the first cracking catalyst may comprise a post-modified USY zeolite, such as a USY zeolite comprising titanium, zirconium, or both, substituted into the zeolite framework. Suitable cracking catalysts may have a bulk density of from 500 kilograms per cubic meter ($kg/m^3$) to 1000 $kg/m^3$, an average particle diameter of from 50 micrometres (μm) to 90 μm, a surface area of from 10 square meters per gram ($m^2/g$) to 200 $m^2/g$, a pore volume of from 0.01 millilitres per gram (ml/g) to 0.3 ml/g, or combinations of these. The first cracking catalyst may also be substantially free of a cracking catalyst additive, such as shape-selective zeolites having a pore diameter that is smaller than that of the second cracking catalyst. As used in the present disclosure, the term "substantially free" of a compound refers to a particular mixture, such as the first cracking catalyst, that comprises less than 1 wt. % of the compound. For example, the first cracking catalyst, which may be substantially free of cracking catalyst additive, may comprise less than 1 wt. %, less than 0.9 wt. %, less than 0.8 wt. %, less than 0.7 wt. %, less than 0.6 wt. %, less than 0.5 wt. %, less than 0.4 wt. %, less than 0.3 wt. %, less than 0.2 wt. %, or less than 0.1 wt. % of catalyst additives, based on the total weight of the first cracking catalyst.

The weight ratio of the first cracking catalyst to the hydrocarbon feed 102 in the first mixed catalyst-hydrocarbon stream 208 may be sufficient to cause at least a portion of the hydrocarbon feed 102 to undergo catalytic cracking when under the reaction conditions in the first fluid catalytic cracking reactor 210. The weight ratio of the first cracking catalyst to the hydrocarbon feed 102 in the first mixed catalyst-hydrocarbon stream 208 may be greater than or equal to 1. The weight ratio of the first cracking catalyst to the hydrocarbon feed 102 in the first mixed catalyst-hydrocarbon stream 208 may be from 1 to 60, from 1 to 50, from 1 to 40, from 1 to 30, from 1 to 20, from 1 to 10, from 10 to 60, from 10 to 50, from 10 to 40, from 10 to 30, from 10 to 20, from 20 to 60, from 20 to 50, from 20 to 40, from 20 to 30, from 30 to 60, from 30 to 50, from 30 to 40, from 40 to 60, from 40 to 50, or from 50 to 60. When the weight ratio of the first cracking catalyst to the hydrocarbon feed 102 in the first mixed catalyst-hydrocarbon stream 208 is less than 1, the degree of the catalytic cracking of the hydrocarbon feed 102 may be reduced and the degree of the thermal cracking of the hydrocarbon feed 102 may be increased, which may reduce the yield of olefins from the first fluid catalytic cracking system 200.

The first mixed catalyst-hydrocarbon stream 208 may be passed from the first mixer 206 to the first fluid catalytic cracking reactor 210. The first mixed catalyst-hydrocarbon stream 208 may be passed directly from the first mixer 206 to the first fluid catalytic cracking reactor 210 without passing through an intervening reaction system or separation system that substantially changes the composition of the first mixed catalyst-hydrocarbon stream 208. The first fluid catalytic cracking reactor 210 may be operable to receive the first mixed catalyst-hydrocarbon stream 208 and contact at least a portion of the hydrocarbons in the first mixed catalyst-hydrocarbon stream 208 with at least a portion of the first cracking catalyst in the first mixed catalyst-hydrocarbon stream 208 at reaction conditions that are sufficient to cause at least a portion of the hydrocarbons in the first mixed catalyst-hydrocarbon stream 208 to undergo a catalytic cracking to produce a first fluid catalytic cracking reactor effluent 212 comprising olefins. The first fluid catalytic cracking reactor 210 may be any type of fluid catalytic cracking reactor operable to contact at least a portion of the hydrocarbons in the first mixed catalyst-hydrocarbon stream 208 with at least a portion of the first cracking catalyst in the first mixed catalyst-hydrocarbon stream 208 at reaction conditions sufficient to cause at least a portion of the hydrocarbons in the first mixed catalyst-hydrocarbon stream 208 to undergo a catalytic cracking and produce a first fluid catalytic cracking reactor effluent 212. For example, the first fluid catalytic cracking reactor 210 depicted in FIG. 1 is a downflow reactor, which may be referred to as a downer reactor, where the first mixed catalyst-hydrocarbon stream 208 flows vertically downward through the first fluid catalytic cracking reactor 210. While the first fluid catalytic cracking reactor 210 depicted in FIG. 1 is a downflow reactor, the first fluid catalytic cracking reactor 210 may also be an upflow reactor, which may be referred to as a riser reactor, where the first mixed catalyst-hydrocarbon stream 208 flows vertically upward through the first fluid catalytic cracking reactor 210.

The first fluid catalytic cracking reactor 210 may be operated at temperatures sufficient to cause at least a portion of the hydrocarbons in the first mixed catalyst-hydrocarbon stream 208 to undergo a catalytic cracking and produce a first fluid catalytic cracking reactor effluent 212. The operating temperature of the first fluid catalytic cracking reactor 210 may be maintained by the introduction of steam (not depicted) to the top portion of the first fluid catalytic cracking reactor 210, the heating of the first cracking catalyst to a temperature greater than the operating temperature of the first fluid catalytic cracking reactor 210, or both. The first fluid catalytic cracking reactor 210 may be operated at a temperature greater than or equal to 480° C. For example, the first fluid catalytic cracking reactor 210 may be operated at a temperature of from 480° C. to 700° C., from 480° C. to 660° C., from 480° C. to 620° C., from 480° C. to 580° C., from 580° C. to 700° C., from 580° C. to 660° C., from 580° C. to 620° C., from 620° C. to 700° C., from 620° C. to 660° C., or from 660° C. to 700° C. When the temperature is less than 480° C., the yield of larger hydrocarbons, such as butenes, pentenes, butane, and isobutene, may be increased, which may reduce the yield of light olefins, such as ethylene and propylene, from the first fluid catalytic cracking system 200.

The residence time of the first mixed catalyst-hydrocarbon stream 208 in the first fluid catalytic cracking reactor 210 may be sufficient to cause at least a portion of the hydrocarbons in the first mixed catalyst-hydrocarbon stream 208 to undergo catalytic cracking and produce a first fluid catalytic cracking reactor effluent 212. The residence time of the first mixed catalyst-hydrocarbon stream 208 in the first fluid catalytic cracking reactor 210 may be maintained by the flowrate of the first mixed catalyst-hydrocarbon stream 208 through the first fluid catalytic cracking reactor 210. The residence time of the first mixed catalyst-hydrocarbon stream 208 in the first fluid catalytic cracking reactor 210 may be less than or equal to 30 seconds. For example, the residence time of the first mixed catalyst-hydrocarbon stream 208 in the first fluid catalytic cracking reactor 210 may be from 0.1 seconds to 30 seconds, from 0.1 second to 25 seconds, from 0.1 seconds to 20 seconds, from 0.1 seconds to 15 seconds, from 0.1 seconds to 10 seconds, from 0.1 seconds to 5 seconds, from 5 seconds to 30 seconds, from 5 second to 25 seconds, from 5 seconds to 20 seconds, from 5 seconds to 15 seconds, from 5 seconds to 10 seconds, from 10 seconds to 30 seconds, from 10 second to 25 seconds, from 10 seconds to 20 seconds, from 10 seconds to 15 seconds, from 15 seconds to 30 seconds, from 15 second to 25 seconds, from 15 seconds to 20 seconds, from 20 seconds to 30 seconds, from 20 second to 25 seconds, or from 25 seconds to 30 seconds. When the residence time is greater than 30 seconds, the degree the thermal cracking of the hydrocarbon feed 102 may be increased, which may reduce the yield of olefins from the first fluid catalytic cracking system 200.

The first fluid catalytic cracking reactor effluent 212 may be passed from the first fluid catalytic cracking reactor 210 to the first catalyst separator 214. The first fluid catalytic cracking reactor effluent 212 may be passed directly from the first fluid catalytic cracking reactor 210 to the first catalyst separator 214 without passing through an intervening reaction system or separation system that substantially changes the composition of the first fluid catalytic cracking reactor effluent 212. The first catalyst separator 214 may be operable to receive the first fluid catalytic cracking reactor effluent 212 and separate the catalyst from the first fluid catalytic cracking reactor effluent 212 to produce a spent first cracking catalyst 216 and a first cracked effluent 202. The first catalyst separator 214 may be any type of solid/fluid separation unit operable to separate the solid catalyst particles from the first fluid catalytic cracking reactor effluent 212 to produce a spent first cracking catalyst 216 and a first cracked effluent 202. For example, the first catalyst separator 214 may comprise a gas-solid separator operable to mechanically separate at least a portion of the solids of the first cracking from at least a portion of the gases of the catalytic cracking products of the first fluid catalytic cracking reactor 210. The gas-solid separator may comprise cyclones, deflectors, or both.

After separation, the spent first cracking catalyst 216 may retain at least a residual portion of the catalytic cracking products. The first catalyst separator 214 may further comprise a stripping zone (not depicted), in which a stripping gas, such as steam, may be passed through the spent first cracking catalyst 216 to remove at least a portion of the residual portion of the catalytic cracking products retained by the spent first cracking catalyst 216. The stripping gases and the catalytic cracking products stripped from the spent first cracking catalyst 216 may be combined with the first cracked effluent 202 prior to passing the first cracked effluent 202 to the separation system 300 downstream of the first fluid catalytic cracking system 200.

The spent first cracking catalyst 216 may be passed from the first catalyst separator 214 to the first catalyst regenerator 218. The spent first cracking catalyst 216 may be passed directly from the first catalyst separator 214 to the first catalyst regenerator 218 without passing through an intervening reaction system or separation system that substantially changes the composition of the spent first cracking catalyst 216. The first catalyst regenerator 218 may be operable to regenerate the spent first cracking catalyst 216 in the presence of a first combustion gas 220 to produce the regenerated first cracking catalyst 222. The first combustion gas 220 may comprise one or more of combustion air, oxygen, fuel gas, fuel oil, or combinations of these. In the first catalyst regenerator 218, at least a portion of the coke deposited on the spent first cracking catalyst 216 in the fluid catalytic reactor 210 may oxidize (combust) in the presence of the first combustion gas 220 to form at least carbon dioxide and water, which may be expelled from the first fluid catalytic cracking system 200 as a first exhaust 224. Other organic compounds, such as a residual portion of the catalytic cracking products of the first fluid catalytic cracking reactor 210 remaining in the pores of the spent first cracking catalyst 216, may also oxidize in the presence of the first combustion gas 220 in the first catalyst regenerator 218. Other gases, such as carbon monoxide, may also be formed during coke oxidation in the first catalyst regenerator 218.

Oxidation of the coke deposits produces heat, which may be transferred to and retained by the regenerated first cracking catalyst 222. Thus, regeneration of the used cracking catalyst may further comprise increasing the temperature of the regenerated first cracking catalyst 222 above the operating temperature of the first fluid catalytic cracking reactor 210 in addition to removing coke deposits. In some instances, combustion of the coke deposits on the spent first cracking catalyst 216 may be sufficient to increase the temperature of the regenerated first cracking catalyst 222 to a temperature greater than the operating temperature of the first fluid catalytic cracking reactor 210. However, under some operating conditions and feed compositions, combustion of the coke deposits may not be sufficient to increase the temperature of the regenerated first cracking catalyst 222 above the operating temperature of the first fluid catalytic cracking reactor 210. In these instances, a combustion fuel, such as fuel gas or fuel oil, may be introduced to the first catalyst regenerator 218 to increase the heat transferred to the regenerated first cracking catalyst 222. The regenerated first cracking catalyst 222 may be passed from the first catalyst regenerator 218 to the first mixer 206. The regenerated first cracking catalyst 222 may be passed directly from the first catalyst regenerator 218 to the first mixer 206 without passing through an intervening reaction system or separation system that substantially changes the composition of the regenerated first cracking catalyst 222. The first catalyst regenerator 218 may further comprise one or more catalyst hoppers (not shown) in which the regenerated first cracking catalyst 222 may accumulate before being combined with the hydrocarbon feed 102 in the first mixer 206.

The first fluid catalytic cracking system 200 is depicted in FIG. 1 as comprising a single fluid catalytic cracking reactor 210. However, the first fluid catalytic cracking system 200 may also comprise a plurality of fluid catalytic cracking reactors operated in parallel or in series. When the first fluid catalytic cracking system 200 includes a plurality of fluid catalytic cracking reactors, the first fluid catalytic cracking system 200 may also include a plurality of mixers, a plurality of separators, a plurality of catalyst regenerators, or combinations of these.

The first cracked effluent 202 may be passed from the first fluid catalytic cracking system 200 to the separation system 300. The first cracked effluent 202 may be passed directly from the first fluid catalytic cracking system 200 to the separation system 300 without passing through an intervening reaction system or separation system that substantially changes the composition of the first cracked effluent 202. The first cracked effluent 202 may comprise a mixture of hydrocarbons, including cracked and uncracked hydrocarbons originating from the hydrocarbon feed 102. In particular, the first cracked effluent 202 may comprise one or more olefins, such as ethylene, propylene, butenes, butadienes, or combinations of these. For example, the first cracked effluent 202 may comprise olefins, such as ethylene, propylene, butenes, butadienes, or combinations of these, in an amount greater than or equal to 1 wt. %, greater than or equal to 10 wt. %, greater than or equal to 20 wt. %, greater than or equal to 30 wt. %, greater than or equal to 40 wt. %, or greater than or equal to 50 wt. % based on the total weight of the first cracked effluent 202. The first cracked effluent 202 may further comprise compounds having atmospheric boiling point temperatures less than or equal to 36° C., such as hydrogen, methane, hydrogen sulfide, ammonia, other light gases, such as ethane, propane, and butane, or combinations of these, that are in gaseous form at ambient temperature and pressure. The first cracked effluent 202 may further comprise naphtha comprising hydrocarbons having atmospheric boiling point temperatures from 36° C. to 220° C., light cycle oil comprising hydrocarbons having atmospheric boiling point temperatures from 220° C. to 370° C., heavy cycle oil comprising hydrocarbons having atmospheric boiling point temperatures from 370° C. to 520° C., slurry oil comprising hydrocarbons having atmospheric boiling point temperatures greater than 520° C., or combinations of these. The first cracked effluent 202 may also include other gases from the first fluid catalytic cracking system 200, such as steam introduced to the first fluid catalytic cracking reactor 210 or stripping gases from the first catalyst separator 214.

The separation system 300 may be operable to separate the first cracked effluent 202 to produce a plurality of separated effluents that comprise at least a naphtha effluent 304. The separation system 300 may comprise one or more separators operable to separate the first cracked effluent 202 into a plurality of separated effluents. The separators may comprise flash drums, high-pressure separators, distillation units, fractional distillation units, condensing units, strippers, quench units, debutanizers, depropanizers, de-ethanizers, or combinations of these. For example, the separation system 300 may comprise a fractional distillation unit operable to separate the first cracked effluent 202 to produce at least the naphtha effluent 304. The naphtha effluent 304 may comprise, consist of, or consist essentially of hydrocarbons having atmospheric boiling point temperatures from 36° C. to 220° C., which may include olefins, such as ethylene, propylene, and butenes. The naphtha effluent 304 may comprise, consist of, or consist essentially of light naphtha comprising hydrocarbon-containing materials having atmospheric boiling points from 36° C. to 80° C., intermediate naphtha comprising hydrocarbon-containing materials having atmospheric boiling points from 80° C. to 140° C., heavy naphtha comprising hydrocarbon-containing materials having atmospheric boiling points from 140° C. to 200° C., or combinations of these. The separation system 300 may also be operable to separate the first cracked effluent 202 into a plurality of separated effluents, such as a light gas effluent 302 comprising compounds having an atmospheric boiling point less than or equal to 36° C., a light cycle oil effluent (not depicted) comprising hydrocarbons having atmospheric boiling points from 220° C. to 370° C., a heavy cycle oil effluent (not depicted) comprising hydrocarbons having atmospheric boiling points from 370° C. to 520° C., a slurry oil effluent (not depicted) comprising hydrocarbons having atmospheric boiling points greater than 520° C., or combinations of these. One or more of the light gas effluent 302, the light cycle oil effluent, the heavy cycle oil effluent, the slurry oil effluent, or combinations of these may be passed to one or more additional downstream unit operations (not depicted) for further processing.

The naphtha effluent 304 may be passed from the separation system 300 to the second fluid catalytic cracking system 400. The naphtha effluent 304 may be passed directly from the separation system 300 to the second fluid catalytic cracking system 400 without passing through an intervening reaction system or separation system that substantially changes the composition of the naphtha effluent 304. For example, the feed stream to the second fluid catalytic cracking system 400 may consist of or consist essentially of the naphtha effluent 304. In embodiments, one or more of the light gas effluent 302, the light cycle oil effluent, the heavy cycle oil effluent, the slurry oil effluent, or combinations of these are not passed from the separation system 300 to the second fluid catalytic cracking system 400.

The second mixer 406 may be operable to receive the naphtha effluent 304 and combine the naphtha effluent 304 with a cracking catalyst mixture to form a second mixed catalyst-hydrocarbon stream 408. The cracking catalyst mixture may comprise a regenerated cracking catalyst mixture 422, a fresh cracking catalyst mixture 404, or both. For example, during an initial start-up of the second fluid catalytic cracking system 400 the cracking catalyst mixture may comprise only the fresh cracking catalyst mixture 404. However, during a steady-state operation of the second fluid catalytic cracking system 400 the cracking catalyst mixture may comprise only the regenerated cracking catalyst mixture 422. The fresh cracking catalyst mixture 404 may also be introduced to the second mixer 406 during steady-state operation of the second fluid catalytic cracking system 400 to replenish any of the cracking catalyst mixture that is lost due to attrition or removed due to permanent deactivation. Fresh second cracking catalyst or fresh cracking catalyst additive may also be introduced to the second mixer 406 during steady-state operation of the second fluid catalytic cracking system 400 to replenish either of these constituents of the cracking catalyst mixture lost due to attrition or permanent deactivation.

The cracking catalyst mixture may comprise a second cracking catalyst, a cracking catalyst additive, or both, that may be suitable for use under the high-severity conditions in the second fluid catalytic cracking reactor 410. The cracking catalyst mixture may also be operable as a heat carrier and may provide heat transfer to the naphtha effluent 304 in the second mixer 406. The cracking catalyst mixture may also have a plurality of catalytically active sites, such as acidic sites that promote the catalytic cracking of at least a portion of the naphtha effluent 304. The second cracking catalyst may comprise one or more cracking catalysts suitable for use under the high-severity conditions in the second fluid catalytic cracking reactor 410. Suitable cracking catalysts may comprise natural or synthetic zeolites, such as Y zeolites, REY zeolites, USY zeolites, and RE-USY zeolites; clays, such as kaolin, montmorilonite, halloysite, and bentonite; inorganic porous oxides, such as alumina, silica, boria, chromia, magnesia, zirconia, titania and silica-alumina; or combinations of these. For example, the second cracking catalyst may comprise a post-modified USY zeolite, such as a USY zeolite comprising titanium, zirconium, or both substituted into the zeolite framework. Suitable cracking catalysts may have a bulk density of from 500 kilograms per cubic meter ($kg/m^3$) to 1000 $kg/m^3$, an average particle diameter of from 50 micrometres (μm) to 90 μm, a surface area of from 10 square meters per gram ($m^2/g$) to 200 $m^2/g$, a pore volume of from 0.01 millilitres per gram (ml/g) to 0.3 ml/g, an average pore diameter of from 10 nanometers (nm) to 60 nm, or combinations of these. The cracking catalyst mixture may comprise less than or equal to 80 weight percent (wt. %) of the second cracking catalyst based on the total weight of the cracking catalyst mixture. For example, the cracking catalyst mixture may comprise from 0 wt. % to 80 wt. %, from 0 wt. % to 60 wt. %, from 0 wt. % to 40 wt. %, from 0 wt. % to 20 wt. %, from 20 wt. % to 80 wt. %, from 20 wt. % to 60 wt. %, from 20 wt. % to 40 wt. %, from 40 wt. % to 80 wt. %, from 40 wt. % to 60 wt. %, or from 60 wt. % to 80 wt. % based on the total weight of the cracking catalyst mixture.

The cracking catalyst additive may comprise one or more shape-selective zeolites suitable for use under the high-severity conditions in the second fluid catalytic cracking reactor 410. As used in the present disclosure, the term "shape-selective zeolite" refers to a zeolite having a pore diameter that is smaller than that of the second cracking catalyst. Without being bound by any particular theory, it is believed this smaller pore diameter limits the hydrocarbon compounds that are capable of passing through the pores and reaching the catalytically active sites of the zeolite. This shape-selectivity may increase the selectivity and yield of light olefins from the second fluid catalytic cracking system 400. Suitable cracking catalyst additives may comprise ZSM-5 zeolites, Beta zeolites, zeolite omega, SAPO-5 zeolites, SAPO-11 zeolites, SAPO-34 zeolites, and pentasil-type aluminosilicates. Suitable cracking catalyst additives may have a bulk density of from 500 $kg/m^3$ to 1000 $kg/m^3$, an average particle diameter of from 50 μm to 90 μm, a surface area of from 10 $m^2/g$ to 200 $m^2/g$, a pore volume of from 0.01 ml/g to 0.3 ml/g, an average pore diameter of from 0.5 nm to 0.6 nm, or combinations of these. The cracking catalyst mixture may comprise greater than or equal to 20 wt. % of the cracking catalyst additive based on the total weight of the cracking catalyst mixture. For example, the cracking catalyst mixture may comprise from 20 wt. % to 100 wt. %, from 20 wt. % to 90 wt. %, from 20 wt. % to 80 wt. %, from 20 wt. % to 70 wt. %, from 20 wt. % to 60 wt. %, from 20 wt. % to 50 wt. %, from 20 wt. % to 40 wt. %, from 20 wt. % to 30 wt. %, from 30 wt. % to 100 wt. %, from 30 wt. % to 90 wt. %, from 30 wt. % to 80 wt. %, from 30 wt. % to 70 wt. %, from 30 wt. % to 60 wt. %, from 30 wt. % to 50 wt. %, from 30 wt. % to 40 wt. %, from 40 wt. % to 100 wt. %, from 40 wt. % to 90 wt. %, from 40 wt. % to 80 wt. %, from 40 wt. % to 70 wt. %, from 40 wt. % to 60 wt. %, from 40 wt. % to 50 wt. %, from 50 wt. % to 100 wt. %, from 50 wt. % to 90 wt. %, from 50 wt. % to 80 wt. %, from 50 wt. % to 70 wt. %, from 50 wt. % to 60 wt. %, from 60 wt. % to 100 wt. %, from 60 wt. % to 90 wt. %, from 60 wt. % to 80 wt. %, from 60 wt. % to 70 wt. %, from 70 wt. % to 100 wt. %, from 70 wt. % to 90 wt. %, from 70 wt. % to 80 wt. %, from 80 wt. % to 100 wt. %, from 80 wt. % to 90 wt. %, or from 90 wt. % to 100 wt. % based on the total weight of the cracking catalyst mixture.

The weight ratio of the cracking catalyst additive of the cracking catalyst mixture to the naphtha effluent 304 in the second mixed catalyst-hydrocarbon stream 408 may be sufficient to cause at least a portion of the naphtha effluent 304 to undergo catalytic cracking when under the high-severity conditions in the second fluid catalytic cracking reactor 410 and produce one or more light olefins. The weight ratio of the cracking catalyst additive of the cracking catalyst mixture to the naphtha effluent 304 in the second mixed catalyst-hydrocarbon stream 408 may be greater than or equal to 1. For example, the weight ratio of the cracking catalyst additive of the cracking catalyst mixture to the naphtha effluent 304 in the second mixed catalyst-hydrocarbon stream 408 may be from 1 to 10, from 1 to 8, from 1 to 6, from 1 to 4, from 1 to 2, from 2 to 10, from 2 to 8, from 2 to 6, from 2 to 4, from 4 to 10, from 4 to 8, from 4 to 6, from 6 to 10, from 6 to 8, or from 8 to 10. When the weight ratio of the cracking catalyst additive of the cracking catalyst mixture to the naphtha effluent 304 in the second mixed catalyst-hydrocarbon stream 408 is less than 1, the degree of the catalytic cracking of the hydrocarbons in the naphtha effluent 304 may be reduced and the degree of the thermal cracking of the hydrocarbons in the naphtha effluent 304 may be increased, which may reduce the yield of olefins from the second fluid catalytic cracking system 400.

The second mixed catalyst-hydrocarbon stream 408 may be passed from the second mixer 406 to the second fluid catalytic cracking reactor 410. The second mixed catalyst-hydrocarbon stream 408 may be passed directly from the second mixer 408 to the second fluid catalytic cracking reactor 410 without passing through an intervening reaction system or separation system that substantially changes the composition of the second mixed catalyst-hydrocarbon stream 408. The second fluid catalytic cracking reactor 410 may be operable to receive the second mixed catalyst-hydrocarbon stream 408 and contact at least a portion of the hydrocarbons in the second mixed catalyst-hydrocarbon stream 408 with at least a portion of the cracking catalyst mixture in the second mixed catalyst-hydrocarbon stream 408 at conditions sufficient to cause at least a portion of the hydrocarbons in the second mixed catalyst-hydrocarbon stream 408 to undergo catalytic cracking and produce a second fluid catalytic cracking reactor effluent 412. The second fluid catalytic cracking reactor 410 may be any type of fluid catalytic cracking reactor operable to contact at least a portion of the hydrocarbons in the second mixed catalyst-hydrocarbon stream 408 with at least a portion of the cracking catalyst mixture in the second mixed catalyst-hydrocarbon stream 408 at reaction conditions sufficient to cause at least a portion of the hydrocarbons in the second mixed catalyst-hydrocarbon stream 408 to undergo catalytic cracking and produce a second fluid catalytic cracking reactor effluent 412. For example, the second fluid catalytic cracking reactor 410 depicted in FIG. 1 is a downflow reactor, also referred to as a downer reactor, where the second mixed catalyst-hydrocarbon stream 408 flows vertically downward through the second fluid catalytic cracking reactor 410. While the second fluid catalytic cracking reactor 410 depicted in FIG. 1 is a downflow reactor, the second fluid catalytic cracking reactor 410 may also be an upflow reactor, also referred to as a riser reactor, where the second mixed catalyst-hydrocarbon stream 408 flows vertically upward through the second fluid catalytic cracking reactor 410.

The second fluid catalytic cracking reactor 410 may be operated at temperatures sufficient to cause at least a portion of the hydrocarbons in the second mixed catalyst-hydrocarbon stream 408 to undergo catalytic cracking and produce a second fluid catalytic cracking reactor effluent 412. The operating temperature of the second fluid catalytic cracking reactor 410 may be maintained by the introduction of steam (not depicted) to the top portion of the second fluid catalytic cracking reactor 410, the heating of the cracking catalyst mixture to a temperature greater than the operating temperature of the second fluid catalytic cracking reactor 410, or both. The second fluid catalytic cracking reactor 410 may be operated at a temperature greater than or equal to 580° C. For example, the first fluid catalytic cracking reactor 210 may be operated at a temperature of from 580° C. to 700° C., from 580° C. to 680° C., from 580° C. to 660° C., from 580° C. to 640° C., from 580° C. to 620° C., from 580° C. to 600° C., from 600° C. to 700° C., from 600° C. to 680° C., from 600° C. to 660° C., from 600° C. to 640° C., from 600° C. to 620° C., from 620° C. to 700° C., from 620° C. to 680° C., from 620° C. to 660° C., from 620° C. to 640° C., from 640° C. to 700° C., from 640° C. to 680° C., from 640° C. to 660° C., from 660° C. to 700° C., from 660° C. to 680° C., or from 680° C. to 700° C. When the temperature is less than 580° C., the yield of larger hydrocarbons, such as butenes, pentenes, butane, and isobutene, may be increased, which may reduce the yield of light olefins, such as ethylene and propylene, from the first fluid catalytic cracking system 200.

The residence time of the second mixed catalyst-hydrocarbon stream 408 in the second fluid catalytic cracking reactor 410 may be sufficient to cause at least a portion of the hydrocarbons in the second mixed catalyst-hydrocarbon stream 408 to undergo catalytic cracking and produce a second fluid catalytic cracking reactor effluent 412. The residence time of the second mixed catalyst-hydrocarbon stream 408 in the second fluid catalytic cracking reactor 410 may be maintained by the flowrate of the second mixed catalyst-hydrocarbon stream 408 through the second fluid catalytic cracking reactor 410. The residence time of the second mixed catalyst-hydrocarbon stream 408 in the second fluid catalytic cracking reactor 410 may be less than or equal to 60 seconds. For example, the residence time of the second mixed catalyst-hydrocarbon stream 408 in the second fluid catalytic cracking reactor 410 may be from 0.1 seconds to 60 seconds, from 0.1 second to 50 seconds, from 0.1 seconds to 40 seconds, from 0.1 seconds to 30 seconds, from 0.1 seconds to 20 seconds, from 0.1 seconds to 10 seconds, from 10 seconds to 60 seconds, from 10 second to 50 seconds, from 10 seconds to 40 seconds, from 10 seconds to 30 seconds, from 10 seconds to 20 seconds, from 20 seconds to 60 seconds, from 20 second to 50 seconds, from 20 seconds to 40 seconds, from 20 seconds to 30 seconds, from 30 seconds to 60 seconds, from 30 second to 50 seconds, from 30 seconds to 40 seconds, from 40 seconds to 60 seconds, from 40 second to 50 seconds, or from 50 seconds to 60 seconds. When the residence time is greater than 60 seconds, the degree the thermal cracking of the hydrocarbons in the naphtha effluent 304 may be increased, which may reduce the yield of olefins from the second fluid catalytic cracking system 400.

The second fluid catalytic cracking reactor effluent 412 may be passed from the second fluid catalytic cracking reactor 410 to the second catalyst separator 414. The second fluid catalytic cracking reactor effluent 412 may be passed directly from the second fluid catalytic cracking reactor 410 to the second catalyst separator 414 without passing through an intervening reaction system or separation system that substantially changes the composition of the fluid catalytic cracking reactor effluent 414. The second catalyst separator 414 may be operable to receive the second fluid catalytic cracking reactor effluent 412 and separate the second fluid catalytic cracking reactor effluent 412 to produce a spent cracking catalyst mixture 416 and a second cracked effluent 402. The second catalyst separator 414 may be any type of unit operable to separate the second fluid catalytic cracking reactor effluent 412 to produce a spent cracking catalyst mixture 416 and a second cracked effluent 402. For example, the second catalyst separator 414 may comprise a gas-solid separator operable to mechanically separate at least a portion of the solids of the cracking catalyst mixture from at least a portion of the gases of the catalytic cracking products of the second fluid catalytic cracking reactor 410. The gas-solid separator may comprise cyclones, deflectors, or both. After separation, the spent cracking catalyst mixture 416 may retain at least a residual portion of the catalytic cracking products. The second catalyst separator 414 may further comprise a stripping zone (not depicted), in which a stripping gas, such as steam, is passed through the spent cracking catalyst mixture 416 to remove at least a portion of the residual portion of the catalytic cracking products retained by the spent cracking catalyst mixture 416. The stripping gases and the catalytic cracking products stripped from the spent cracking catalyst mixture 416 may be combined with the second cracked effluent 402 prior to passing the second cracked effluent 402 to any downstream components or out of the system 100.

The spent cracking catalyst mixture 416 may be passed from the second catalyst separator 414 to the second catalyst regenerator 418. The spent cracking catalyst mixture 416 may be passed directly from the second catalyst separator 414 to the second catalyst regenerator 418 without passing through an intervening reaction system or separation system that substantially changes the composition of the spent cracking catalyst mixture 416. The second catalyst regenerator 418 may be operable to regenerate the spent cracking catalyst mixture 416 in the presence of a second combustion gas 420 to produce the regenerated cracking catalyst mixture 422. The second combustion gas 420 may comprise one or more of combustion air, oxygen, fuel gas, fuel oil, or combinations of these. In the second catalyst regenerator 418, at least a portion of the coke deposited on the spent cracking catalyst mixture 416 in the fluid catalytic reactor 410 may oxidize (combust) in the presence of the second combustion gas 420 to form at least carbon dioxide and water, which may be expelled from the second fluid catalytic cracking system 400 as a second exhaust 424. Other organic compounds, such as a residual portion of the catalytic cracking products of the second fluid catalytic cracking reactor 410 remaining in the pores of the spent cracking catalyst mixture 416, may also oxidize in the presence of the second combustion gas 420 in the second catalyst regenerator 418. Other gases, such as carbon monoxide, may also be formed during coke oxidation in the second catalyst regenerator 418.

Oxidation of the coke deposits produces heat, which may be transferred to and retained by the regenerated cracking catalyst mixture 422. Thus, regeneration of the spent cracking catalyst mixture 416 may further comprise increasing the temperature of the regenerated cracking catalyst mixture 422 above the operating temperature of the second fluid catalytic cracking reactor 410 in addition to removing coke deposits. In some instances, combustion of the coke deposits on the spent cracking catalyst mixture 416 may be sufficient to increase the temperature of the regenerated cracking catalyst mixture 422 to a temperature greater than the operating temperature of the second fluid catalytic cracking reactor 410. However, under some operating conditions and feed compositions, combustion of the coke deposits may not be sufficient to increase the temperature of the regenerated cracking catalyst mixture 422 above the operating temperature of the second fluid catalytic cracking reactor 410. In these instances, a combustion fuel, such as fuel gas or fuel oil, may be introduced to the second catalyst regenerator 418 to increase the heat transferred to the regenerated cracking catalyst mixture 422. The regenerated cracking catalyst mixture 422 may be passed from the second catalyst regenerator 418 to the second mixer 406. The regenerated cracking catalyst mixture 422 may be passed directly from the second catalyst regenerator 418 to the second mixer 406 without passing through an intervening reaction system or separation system that substantially changes the composition of the regenerated cracking catalyst mixture 422. The second catalyst regenerator 418 may further comprise one or more catalyst hoppers (not shown) in which the regenerated cracking catalyst mixture 422 may accumulate before being combined with the naphtha effluent 304 in the second mixer 406.

The second cracked effluent 402 may be passed out of the second fluid catalytic cracking system 400 and out of the system 100. The second cracked effluent 402 may comprise a mixture of hydrocarbon-containing materials, including cracked hydrocarbons from the naphtha effluent 304. In particular, the second cracked effluent 402 may comprise one or more olefins, such as ethylene, propylene, butenes, butadienes, or combinations of these. Without being bound by any particular theory, it is believed that the use of two fluid catalytic cracking systems in series, as well as a cracking catalyst additive in the second fluid catalytic cracking system, the yield of light olefins may be increased. In particular, the second cracked effluent 402 may comprise light olefins, such as ethylene and propylene, in amounts greater than any other compound in the second cracked effluent 402. For example, the second cracked effluent 402 may comprise light olefins, such as ethylene and propylene, in an amount greater than or equal to 5 wt. %, greater than or equal to 10 wt. %, greater than or equal to 15 wt. %, greater than or equal to 20 wt. %, greater than or equal to 25 wt. %, greater than or equal to 30 wt. %, greater than or equal to 35 wt. %, greater than or equal to 40 wt. %, greater than or equal to 45 wt. %, or greater than or equal to 50 wt. % based on the total weight of the second cracked effluent 402.

The second fluid catalytic cracking system 400 is depicted in FIG. 1 as comprising a single fluid catalytic cracking reactor 420. However, the second fluid catalytic cracking system 400 may also comprise a plurality of fluid catalytic cracking reactors operated in parallel or in series. When the second fluid catalytic cracking system 400 comprises a plurality of fluid catalytic cracking reactors, the second fluid catalytic cracking system 400 may also comprise a plurality of mixers, a plurality of separators, a plurality of catalyst regenerators, or combinations of these.

Both the first catalytic cracking system 200 and the second catalytic cracking system 400 are depicted in FIG. 1 as comprising downflow reactors. However, both the first catalytic cracking system 200 and the second catalytic cracking system 400 may comprise downflow reactors, upflow reactors, or combinations of these. For example, both the first catalytic cracking system 200 and the second catalytic cracking system 400 may comprise downflow reactors, both the first catalytic cracking system 200 and the second catalytic cracking system 400 may comprise upflow reactors, the first catalytic cracking system 200 may comprise an upflow reactor and the second catalytic cracking system 400 may comprise a downflow reactor, or the first catalytic cracking system 200 may comprise a downflow reactor and the second catalytic cracking system 400 may comprise an upflow reactor Referring again to FIG. 1, methods for processing hydrocarbon feeds under high-severity conditions to produce olefins may be conducted using the system 100 of the present disclosure. The method may comprise introducing the hydrocarbon feed 102 to the first fluid catalytic cracking system 200. The first fluid catalytic cracking system 200 may contact the hydrocarbon feed 102 with a first cracking catalyst at a first cracking temperature greater than or equal to 580° C. The contact of the hydrocarbon feed 102 with the first cracking catalyst at the first cracking temperature may cause at least a portion of the hydrocarbon feed 102 to undergo catalytic cracking and produce a spent first cracking catalyst 216 and a first cracked effluent 202 comprising one or more olefins. The method may further comprise passing the first cracked effluent 202 to the separation system 300 downstream of the first fluid catalytic cracking system 200. The separation system 200 may separate the first cracked effluent 202 to produce at least a naphtha effluent 304 comprising one or more olefins. The method may further comprise passing the naphtha effluent 304 to the second fluid catalytic cracking system 400 downstream of the separation system 300. The second fluid catalytic cracking system 400 may contact the naphtha effluent 304 with a cracking catalyst mixture comprising a second cracking catalyst and a cracking catalyst additive at a second cracking temperature greater than or equal to 580° C. The contact of the naphtha effluent 304 with the cracking catalyst mixture at the second cracking temperature may cause at least a portion of the naphtha effluent 304 to undergo catalytic cracking and produce a spent cracking catalyst mixture 416 and a second cracked effluent 402 comprising one or more olefins.

EXAMPLES

The various aspects of methods for processing hydrocarbon feeds under high-severity conditions to produce olefins will be further clarified by the following examples. The examples are illustrative in nature and should not be understood to limit the subject matter of the present disclosure.

Example 1

In Example 1, a hydrocarbon feed was catalytically cracked under high-severity conditions in an ACE Technology® model R+ cracking unit operated at a temperature of 600° C. The hydrocarbon feed was a greater boiling point fraction of an effluent of a two-stage recycle hydrocracking process, the properties of which are reported in Table 1. The catalyst was a USY-type zeolite comprising titanium and zirconium within the zeolite framework produced according to the methods described in U.S. Pat. No. 10,357,761. At the start of operation of the cracking unit for each example, a fixed quantity of the catalyst was transferred to the reactor and heated to the desired reaction temperature of 600° C. with nitrogen gas. The nitrogen gas was fed through the feed injector and into the reactor from the bottom of the reactor to keep the catalyst particles fluidized. When the catalyst bed temperature was within ±1° C. of the reaction temperature of 600° C., the feed was injected for a preset duration of time of 30 seconds. During the 30 second injection time, the hydrocarbon feed passed through the catalyst continuously. The feed pump was calibrated at the feed temperature to deliver an amount of the hydrocarbon feed to maintain the desired catalyst to oil weight ratio. The process was repeated four times with varying weight ratios of the cracking catalyst to the hydrocarbon feed. The operating conditions of the processes and the properties of the resulting effluents are reported in Table 2.

TABLE 1

| Properties | Units | Values | Test Methods |
|---|---|---|---|
| Density (at 15.6° C.) | $kg/m^3$ | 829.3 | ASTM D287 |
| Micro Carbon Residue | wt. % | 0.02 | ASTM D4530 |
| Nitrogen Content | ppmw | <5 | ASTM D4629 |
| Sulfur Content | wt. % | 0.0005 | ASTM D4294 |
| Hydrogen Content | wt. % | 13.77 | ASTM D5292 |
| Boiling Point Distribution | | | |
| Initial Boiling Point | ° C. | 288 | ASTM D3710 |
| 5% Boiling Point | ° C. | 357 | ASTM D3710 |
| 10% Boiling Point | ° C. | 378 | ASTM D3710 |
| 20% Boiling Point | ° C. | 401 | ASTM D3710 |
| 30% Boiling Point | ° C. | 417 | ASTM D3710 |
| 40% | ° C. | 431 | ASTM D3710 |
| 50% | ° C. | 442 | ASTM D3710 |
| 60% | ° C. | 454 | ASTM D3710 |
| 70% | ° C. | 468 | ASTM D3710 |
| 80% | ° C. | 512 | ASTM D3710 |
| 90% | ° C. | 536 | ASTM D3710 |
| Final Boiling Point | ° C. | 608 | ASTM D3710 |

TABLE 2

| Operating Conditions | | | | |
|---|---|---|---|---|
| Temperature (° C.) | 600.0 | 600.0 | 600.0 | 600.0 |
| Residence Time (seconds) | 30.0 | 30.0 | 30.0 | 30.0 |
| Weight Ratio of Cracking Catalyst to Hydrocarbon Feed | 3.1 | 4.0 | 5.1 | 6.1 |
| Effluent Properties | | | | |
| Conversion (wt. %) | 83.7 | 86.4 | 87.8 | 88.7 |
| Yields | | | | |
| Hydrogen (wt. %) | 0.09 | 0.10 | 0.11 | 0.12 |
| Methane (wt. %) | 1.26 | 1.31 | 1.48 | 1.55 |
| Ethane (wt. %) | 0.84 | 0.85 | 0.94 | 0.95 |
| Ethylene (wt. %) | 1.74 | 1.80 | 1.93 | 2.04 |
| Propane (wt. %) | 1.51 | 1.71 | 1.88 | 2.08 |
| Propylene (wt. %) | 15.23 | 16.09 | 16.47 | 17.06 |
| Isobutane (wt. %) | 4.64 | 5.07 | 5.42 | 5.81 |
| n-Butane (wt. %) | 1.23 | 1.38 | 1.46 | 1.55 |
| 1-Butene (wt. %) | 3.56 | 3.70 | 3.73 | 3.70 |
| Isobutylene (wt. %) | 7.46 | 7.51 | 7.39 | 7.29 |
| Cis-2-Butene (wt. %) | 3.94 | 4.04 | 4.03 | 3.97 |
| Trans-2-Butene (wt. %) | 5.52 | 5.63 | 5.58 | 5.51 |
| 1,3-Butadiene (wt. %) | 0.22 | 0.17 | 0.17 | 0.14 |
| Gasoline (wt. %) | 35.53 | 35.56 | 35.29 | 34.96 |
| Light Cycle Oil (wt. %) | 6.72 | 6.15 | 5.91 | 5.62 |
| Heavy Cycle Oil (wt. %) | 9.54 | 7.45 | 6.26 | 5.65 |
| Coke (wt. %) | 0.98 | 1.48 | 1.95 | 2.00 |

Example 2

In Example 2, a hydrocarbon feed comprising the liquid products recovered from the catalytic cracking of the hydrocarbon feed of Example 1 at a catalyst to oil weight ratio of 6.1, which included the naphtha fraction of the products recovered from Example 1, was catalytically cracked under high-severity conditions in in an ACE Technology® model R+ cracking unit operated at a temperature of 600° C. The catalyst used was a mixture including 10 wt % of a ZSM-5 zeolite and 90 wt. % of a USY-type zeolite based on the total weight of the mixture. The USY-type zeolite comprised titanium and zirconium within the zeolite framework, and was produced according to the methods described in U.S. Pat. No. 10,357,761. At the start of operation of the cracking unit for each example, a fixed quantity of catalyst mixture was transferred to the reactor and heated to the desired reaction temperature of 600° C. with nitrogen gas. The nitrogen gas was fed through the feed injector and into the reactor from the bottom of the reactor to keep the catalyst particles fluidized. When the catalyst bed temperature was within ±1° C. of the reaction temperature of 600° C., the feed was injected for a preset duration of time of 60 seconds. During the 60 second residence time, the hydrocarbon feed passed through the catalyst continuously. The feed pump was calibrated at the feed temperature to deliver an amount of the hydrocarbon feed to maintain the desired catalyst to oil weight ratio. The operating conditions of the processes and the properties of the resulting effluents are reported in Table 3.

TABLE 3

| Operating Conditions | |
|---|---|
| Temperature (° C.) | 600.0 |
| Residence Time (seconds) | 60.0 |
| Weight Ratio of Cracking Catalyst to Hydrocarbon Feed | 0.5 |
| **Effluent Properties** | |
| Conversion (wt. %) | 32.5 |
| **Yields** | |
| Hydrogen (wt. %) | 0.00 |
| Methane (wt. %) | 0.00 |
| Ethane (wt. %) | 0.00 |
| Ethylene (wt. %) | 8.84 |
| Propane (wt. %) | 1.54 |
| Propylene (wt. %) | 9.35 |
| Isobutane (wt. %) | 0.00 |
| n-Butane (wt. %) | 0.16 |
| 1-Butene (wt. %) | 0.02 |
| Isobutylene (wt. %) | 0.48 |
| Cis-2-Butene (wt. %) | 0.04 |
| Trans-2-Butene (wt. %) | 0.02 |
| 1,3-Butadiene (wt. %) | 0.00 |
| Gasoline (wt. %) | 0.00 |
| Light Cycle Oil (wt. %) | 0.00 |
| Heavy Cycle Oil (wt. %) | 0.00 |
| Coke (wt. %) | 0.00 |

A first aspect of the present disclosure may comprise a method for processing a hydrocarbon feed to produce olefins comprising contacting the hydrocarbon feed with a first cracking catalyst at a first cracking temperature greater than or equal to 480 degrees Celsius. The contact may cause at least a portion of the hydrocarbon feed to undergo catalytic cracking and produce a spent first cracking catalyst and a first cracked effluent comprising one or more olefins. The method may further comprise separating the first cracked effluent to produce at least a naphtha effluent comprising one or more olefins. Additionally, the method may comprise contacting the naphtha effluent with a cracking catalyst mixture comprising a cracking catalyst additive at a second cracking temperature greater than or equal to 580 degrees Celsius. The contact may cause at least a portion of the naphtha effluent to undergo catalytic cracking and produce a spent cracking catalyst mixture and a second cracked effluent comprising one or more olefins.

A second aspect of the present disclosure may comprise the first aspect, where contacting the hydrocarbon feed with the fluidized first cracking catalyst at the first cracking temperature comprises introducing the hydrocarbon feed to a first fluid catalytic cracking system that contacts the hydrocarbon feed with the fluidized first cracking catalyst at the first cracking temperature.

A third aspect of the present disclosure may comprise the second aspect, where a weight ratio of the fluidized first cracking catalyst to the hydrocarbon feed in the first fluid catalytic cracking system is from 1 to 60.

A fourth aspect of the present disclosure may comprise either the second or third aspect, where a residence time of the hydrocarbon feed in the first fluid catalytic cracking system is less than or equal to 30 seconds.

A fifth aspect of the present disclosure may comprise any one of the second through fourth aspects, where the first fluid catalytic cracking system comprises a downflow reactor, an upflow reactor, or both.

A sixth aspect of the present disclosure may comprise any one of the first through fifth aspects, where separating the first cracked effluent comprises passing the first cracked effluent to a separation system that separates the first cracked effluent.

A seventh aspect of the present disclosure may comprise any one of the first through sixth aspects, where contacting the naphtha effluent with the fluidized cracking catalyst mixture at the second cracking temperature comprises passing the naphtha effluent to a second fluid catalytic cracking system that contacts the naphtha effluent with the fluidized cracking catalyst mixture at the second cracking temperature.

An eighth aspect of the present disclosure may comprise the seventh aspect, where a weight ratio of the fluidized cracking catalyst additive to the naphtha effluent in the second fluid catalytic cracking system is from 1 to 10.

A ninth aspect of the present disclosure may comprise either the seventh or eighth aspect, where a residence time of the naphtha effluent in the second fluid catalytic cracking system is less than or equal to 60 seconds.

A tenth aspect of the present disclosure may comprise any one of the seventh through ninth aspects, where the second fluid catalytic cracking system comprises a downflow reactor, an upflow reactor, or both.

An eleventh aspect of the present disclosure may comprise any one of the first through tenth aspects, further comprising regenerating at least a portion of the spent first cracking catalyst to produce a regenerated first cracking catalyst and recycling at least a portion of the regenerated first cracking catalyst such that the fluidized first cracking catalyst comprises at least a portion of the regenerated first cracking catalyst.

A twelfth aspect of the present disclosure may comprise the eleventh aspect, where regenerating at least a portion of the spent first cracking catalyst comprises passing the spent first cracking catalyst to a first catalyst regenerator that regenerates at least a portion of the spent first cracking catalyst and recycling at least a portion of the regenerated first cracking catalyst comprises passing at least a portion of the regenerated first catalyst to the first fluid catalytic cracking system.

A thirteenth aspect of the present disclosure may comprise any one of the first through twelfth aspects, further comprising regenerating at least a portion of the spent cracking catalyst mixture to produce a regenerated cracking catalyst mixture and recycling at least a portion of the regenerated cracking catalyst mixture such that the fluidized cracking catalyst mixture comprises at least a portion of the regenerated cracking catalyst mixture.

A fourteenth aspect of the present disclosure may comprise the thirteenth aspect, where regenerating at least a portion of the spent cracking catalyst mixture comprises passing the spent cracking catalyst mixture to a second catalyst regenerator that regenerates at least a portion of the spent cracking catalyst mixture and recycling at least a portion of the regenerated cracking catalyst mixture comprises passing at least a portion of the regenerated cracking catalyst mixture to the second fluid catalytic cracking system.

A fifteenth aspect of the present disclosure may comprise a method for processing a hydrocarbon feed to produce olefins comprises introducing the hydrocarbon feed to a first fluid catalytic cracking system. The first fluid catalytic cracking system may contact the hydrocarbon feed with a first cracking catalyst at a first cracking temperature greater than or equal to 480 degrees Celsius. The contact may cause at least a portion of the hydrocarbon feed to undergo catalytic cracking and produce a spent first cracking catalyst and a first cracked effluent comprising one or more olefins. The method may further comprise passing the first cracked effluent to a separation system downstream of the first fluid catalytic cracking system. The separation system may separate the first cracked effluent to produce at least a naphtha effluent comprising one or more olefins. Additionally, the method may comprise passing the naphtha effluent to a second fluid catalytic cracking system downstream of the separation system. The second fluid catalytic cracking system may contact the naphtha effluent with a cracking catalyst mixture comprising a cracking catalyst additive at a second cracking temperature greater than or equal to 580 degrees Celsius. The contact may cause at least a portion of the naphtha effluent to undergo catalytic cracking and produce a spent cracking catalyst mixture and a second cracked effluent comprising one or more olefins.

A sixteenth aspect of the present disclosure may comprise the fifteenth aspect, further comprising passing the spent first cracking catalyst to a first catalyst regenerator that regenerates at least a portion of the spent first cracking catalyst to produce a regenerated first cracking catalyst and passing at least a portion of the regenerated first cracking catalyst to the first fluid catalytic cracking system such that the first cracking catalyst comprises at least a portion of the regenerated first cracking catalyst.

A seventeenth aspect of the present disclosure may comprise either the fifteenth or sixteenth aspect, further comprising passing the spent cracking catalyst mixture to a second catalyst regenerator that regenerates at least a portion of the spent cracking catalyst mixture to produce a regenerated cracking catalyst mixture and passing at least a portion of the regenerated cracking catalyst mixture to the second fluid catalytic cracking system such that the cracking catalyst mixture comprises at least a portion of the regenerated cracking catalyst mixture.

An eighteenth aspect of the present disclosure may comprise any one of the fifteenth through seventeenth aspects, where a weight ratio of the first cracking catalyst to the hydrocarbon feed in the first fluid catalytic cracking system is from 1 to 60.

A nineteenth aspect of the present disclosure may comprise any one of the fifteenth through eighteenth aspects, where a residence time of the hydrocarbon feed in the first fluid catalytic cracking system is less than or equal to 30 seconds.

A twentieth aspect of the present disclosure may comprise any one of the fifteenth through nineteenth aspects, where the first fluid catalytic cracking system comprises a downflow reactor, an upflow reactor, or both.

A twenty-first aspect of the present disclosure may comprise any one of the fifteenth through twentieth aspects, where a weight ratio of the cracking catalyst additive to the naphtha effluent in the second fluid catalytic cracking system is from 1 to 10.

A twenty-second aspect of the present disclosure may comprise any one of the fifteenth through twenty-first aspects, where a residence time of the naphtha effluent in the second fluid catalytic cracking system is less than or equal to 60 seconds.

A twenty-third aspect of the present disclosure may comprise any one of the fifteenth through twenty-second aspects, where the second fluid catalytic cracking system comprises a downflow reactor, an upflow reactor, or both.

A twenty-fourth aspect of the present disclosure may comprise any one of the first through twenty-third aspects, where the hydrocarbon feed comprises distillates boiling at temperatures from 370 degrees Celsius to 565 degrees Celsius, residues boiling at temperatures greater than or equal to 520 degrees Celsius, or both.

A twenty-fifth aspect of the present disclosure may comprise any one of the first through twenty-fourth aspects, where the first cracking catalyst comprises a USY zeolite, a post-modified USY zeolite comprising titanium and zirconium within the zeolite framework, or both.

A twenty-sixth aspect of the present disclosure may comprise any one of the first through twenty-fifth aspects, where the naphtha effluent comprises hydrocarbons boiling at temperatures from 36 degrees Celsius to 220 degrees Celsius.

A twenty-seventh aspect of the present disclosure may comprise any one of the first through twenty-sixth aspects, where the cracking catalyst mixture comprises greater than or equal to 20 weight percent of the cracking catalyst additive based on the total weight of the cracking catalyst mixture.

A twenty-eighth aspect of the present disclosure may comprise any one of the first through twenty-seventh aspects, where the cracking catalyst mixture further comprises a second cracking catalyst.

A twenty-ninth aspect of the present disclosure may comprise the twenty-eighth aspect, where the cracking catalyst mixture comprises less than or equal to 80 weight percent of the second cracking catalyst based on the total weight of the cracking catalyst mixture.

A thirtieth aspect of the present disclosure may comprise any one of the first through twenty-ninth aspects, where the cracking catalyst additive comprises a ZSM-5 zeolite, a Beta zeolite, or both.

A thirty-first aspect of the present disclosure may comprise a system for processing a hydrocarbon feed to produce olefins comprising a first fluid catalytic cracking system, a separation system downstream of the first fluid catalytic cracking system, and a second fluid catalytic cracking system downstream of the separation system. The first fluid catalytic cracking system may be operable to contact the hydrocarbon feed with a first cracking catalyst at a first cracking temperature greater than or equal to 480 degrees Celsius. The contact may cause at least a portion of the hydrocarbon feed to undergo catalytic cracking and produce a spent first cracking catalyst and a first cracked effluent comprising one or more olefins. The separation system may be operable to separate the first cracked effluent to produce at least a naphtha effluent comprising one or more olefins. The second fluid catalytic cracking system may be operable to contact the naphtha effluent with a cracking catalyst mixture comprising a cracking catalyst additive at a second cracking temperature greater than or equal to 580 degrees Celsius. The contact may cause at least a portion of the naphtha effluent to undergo catalytic cracking and produce a spent cracking catalyst mixture and a second cracked effluent comprising one or more olefins.

A thirty-second aspect of the present disclosure may comprise the thirty-first aspect, where the first fluid catalytic cracking system comprises a first mixer, a first fluid catalytic cracking reactor downstream of the first mixer, and a first catalyst separator downstream of the first fluid catalytic cracking reactor. The first mixer may be operable to receive the hydrocarbon feed and combine the hydrocarbon feed with the first cracking catalyst to form a first mixed catalyst-hydrocarbon stream. The first fluid catalytic cracking reactor may be operable to receive the first mixed catalyst-hydrocarbon stream and contact at least a portion of the hydrocarbon feed in the first mixed catalyst-hydrocarbon stream with at least a portion of the first cracking catalyst in the first mixed catalyst-hydrocarbon stream at the first cracking temperature to produce a first fluid catalytic cracking reactor effluent. The first catalyst separator may be operable to receive the first fluid catalytic cracking reactor effluent and separate the catalyst from the first fluid catalytic cracking reactor effluent to produce the spent first cracking catalyst and the first cracked effluent.

A thirty-third aspect of the present disclosure may comprise the thirty-second aspect, further comprising a first catalyst regenerator downstream of the first catalyst separator. The first catalyst regenerator may be operable to regenerate the spent first cracking catalyst in the presence of a first combustion gas to produce a regenerated first cracking catalyst.

An thirty-fourth aspect of the present disclosure may comprise any one of the thirty-first through thirty-third aspects, where the second fluid catalytic cracking system comprises a second mixer, a second fluid catalytic cracking reactor downstream of the second mixer, and a second catalyst separator downstream of the second fluid catalytic cracking reactor. The second mixer may be operable to receive the naphtha effluent and combine the naphtha effluent with the cracking catalyst mixture to form a second mixed catalyst-hydrocarbon stream. The second fluid catalytic cracking reactor may be operable to receive the second mixed catalyst-hydrocarbon stream and contact at least a portion of the naphtha effluent in the second mixed catalyst-hydrocarbon stream with at least a portion of the cracking catalyst mixture in the second mixed catalyst-hydrocarbon stream at the second cracking temperature to produce a second fluid catalytic cracking reactor effluent. The second catalyst separator may be operable to receive the second fluid catalytic cracking reactor effluent and separate the catalyst from the second fluid catalytic cracking reactor effluent to produce the spent cracking catalyst mixture and the second cracked effluent.

A thirty-fifth aspect of the present disclosure may comprise the thirty-fourth aspect, further comprising a second catalyst regenerator downstream of the second catalyst separator, the second catalyst regenerator operable to regenerate the spent cracking catalyst mixture in the presence of a second combustion gas to produce a regenerated cracking catalyst mixture.

It is noted that any two quantitative values assigned to a property may constitute a range of that property, and all combinations of ranges formed from all stated quantitative values of a given property are contemplated in this disclosure.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Having described the subject matter of the present disclosure in detail and by reference to specific aspects, it is noted that the various details of such aspects should not be taken to imply that these details are essential components of the aspects. Rather, the claims appended hereto should be taken as the sole representation of the breadth of the present disclosure and the corresponding scope of the various aspects described in this disclosure. Further, it will be apparent that modifications and variations are possible without departing from the scope of the appended claims.

What is claimed is:

1. A method for processing a hydrocarbon feed to produce olefins, the method comprising:

introducing the hydrocarbon feed to a first fluid catalytic cracking system comprising a first cracking catalyst, the first cracking catalyst comprising a USY-zeolite having titanium, zirconium, or both substituted into the zeolite framework;

contacting the hydrocarbon feed with the first cracking catalyst at a first cracking temperature greater than or equal to 480 degrees Celsius in the first fluid catalytic cracking system, the contacting causing at least a portion of the hydrocarbon feed to undergo catalytic cracking and produce a spent first cracking catalyst and a first cracked effluent comprising one or more olefins, where the first fluid catalytic cracking system comprises a downflow reactor;

passing the first cracked effluent to a separation system downstream of the first fluid catalytic cracking system, where the separation system separates the first cracked effluent to produce at least a naphtha effluent comprising one or more olefins;

passing the naphtha effluent to a second fluid catalytic cracking system downstream of the separation system, the second fluid catalytic cracking system comprising a cracking catalyst mixture comprising a second cracking catalyst and a cracking catalyst additive, where:

the second cracking catalyst comprises a USY zeolite having titanium, zirconium, or both substituted into the zeolite framework;

the cracking catalyst additive comprising a shape selective zeolite;

the cracking catalyst mixture comprises 90 weight percent of the second cracking catalyst comprising the USY-zeolite, and 10 weight percent of the cracking additive comprising the shape selective zeolite; and contacting the naphtha effluent with the cracking catalyst mixture at a second cracking temperature greater than or equal to 580 degrees Celsius, the contacting causing at least a portion of the naphtha effluent to undergo catalytic cracking and produce a spent cracking catalyst mixture and a second cracked effluent comprising one or more olefins, where the second fluid catalytic cracking system comprises a downflow reactor, and the second cracking catalyst is different from the first cracking catalyst.

2. The method of claim 1, where the hydrocarbon feed comprises distillates boiling at temperatures from 370 degrees Celsius to 565 degrees Celsius, residues boiling at temperatures greater than or equal to 520 degrees Celsius, or both.

3. The method of claim 1, where a weight ratio of the first cracking catalyst to the hydrocarbon feed in the first fluid catalytic cracking system is from 1 to 60 and a residence time of the hydrocarbon feed in the first fluid catalytic cracking system is less than or equal to 30 seconds.

4. The method of claim 1, where the USY zeolite of the first cracking catalyst comprises titanium and zirconium within the zeolite framework.

5. The method of claim 1, where the naphtha effluent comprises hydrocarbons boiling at temperatures from 36 degrees Celsius to 220 degrees Celsius.

6. The method of claim 1, where a weight ratio of the cracking catalyst additive to the naphtha effluent in the second fluid catalytic cracking system is from 1 to 10.

7. The method of claim 1, where the residence time of the naphtha effluent in the second fluid catalytic cracking system is less than or equal to 60 seconds.

8. The method of claim 1, where USY zeolite comprises titanium and zirconium within the zeolite framework.

9. The method of claim 1, further comprising:

passing the spent first cracking catalyst to a first catalyst regenerator that regenerates at least a portion of the spent first cracking catalyst to produce a regenerated first cracking catalyst; and passing at least a portion of the regenerated first cracking catalyst to the first fluid catalytic cracking system such that the first cracking catalyst comprises at least a portion of the regenerated first cracking catalyst.

10. The method of claim 1, further comprising:

passing the spent cracking catalyst mixture to a second catalyst regenerator that regenerates at least a portion of the spent cracking catalyst mixture to produce a regenerated cracking catalyst mixture; and passing at least a portion of the regenerated cracking catalyst mixture to the second fluid catalytic cracking system such that the cracking catalyst mixture comprises at least a portion of the regenerated cracking catalyst mixture.

11. The method of claim 1, further comprising:

combining the hydrocarbon feed with the first cracking catalyst to form a first mixed catalyst-hydrocarbon stream in a first mixer;

contacting at least a portion of the hydrocarbon feed in the first mixed catalyst-hydrocarbon stream with at least a portion of the first cracking catalyst in the first mixed catalyst- hydrocarbon stream at the first cracking temperature to produce a first fluid catalytic cracking reactor effluent in a first fluid catalytic cracking reactor;

separating the catalyst from the first fluid catalytic cracking reactor effluent to produce the spent first cracking catalyst and the first cracked effluent in a first catalyst separator; and regenerating the spent first cracking catalyst in the presence of a first combustion gas to produce the regenerated first cracking catalyst in a first catalyst regenerator.

12. The method of claim 1, further comprising:

combining the naphtha effluent with the cracking catalyst mixture to form a second mixed catalyst-hydrocarbon stream in a second mixer;

contacting at least a portion of the naphtha effluent in the second mixed catalyst-hydrocarbon stream with at least a portion of the cracking catalyst mixture in the second mixed catalyst-hydrocarbon stream at the second cracking temperature to produce a second fluid catalytic cracking reactor effluent in a second fluid catalytic cracking reactor;

separating the catalyst from the second fluid catalytic cracking reactor effluent to produce the spent cracking catalyst mixture and the second cracked effluent in a second catalyst separator; and regenerating the spent cracking catalyst mixture in the presence of a second combustion gas to produce the regenerated cracking catalyst mixture in a second catalyst regenerator.

13. The method of claim 1, where the first cracking temperature is greater than or equal to 600° C.

14. The method of claim 1, where the first cracking catalyst comprises less than 1 wt. % of a shape-selective zeolites having a pore diameter that is smaller than that of the second cracking catalyst.

15. The method of claim 1, where the shape selective zeolite comprises a ZSM-5 zeolite.

16. The method of claim 1, where the first cracking catalyst is substantially free of a cracking catalyst additive comprising one or more shape-selective zeolites comprising ZSM-5 zeolites, Beta zeolites, zeolite omega, SAPO-5 zeolites, SAPO-11 zeolites, SAPO-34 zeolites, pentasil-type aluminosilicates, or combinations thereof.

* * * * *